US008220206B2

(12) United States Patent
Konkey

(10) Patent No.: US 8,220,206 B2
(45) Date of Patent: Jul. 17, 2012

(54) GUTTER FILTER

(75) Inventor: Ken Konkey, East Dundee, IL (US)

(73) Assignee: American Gutter Filter, Inc., East Dundee, IL (US)

( * ) Notice: Subject to any disclaimer, the term of this patent is extended or adjusted under 35 U.S.C. 154(b) by 0 days.

(21) Appl. No.: 12/692,469

(22) Filed: Jan. 22, 2010

(65) Prior Publication Data

US 2010/0170837 A1 Jul. 8, 2010

Related U.S. Application Data

(63) Continuation-in-part of application No. 12/061,419, filed on Apr. 2, 2008, which is a continuation-in-part of application No. 11/107,770, filed on Apr. 15, 2005, now abandoned.

(60) Provisional application No. 60/562,649, filed on Apr. 15, 2004.

(51) Int. Cl.
*B01D 35/02* (2006.01)
*B23P 17/04* (2006.01)

(52) U.S. Cl. ..... 52/12; 52/11; 210/162; 210/455; 210/483

(58) Field of Classification Search ..... 52/12, 11; 210/162, 455, 483
See application file for complete search history.

(56) References Cited

U.S. PATENT DOCUMENTS 3,479,784 A * 11/1969 Massagli ..... 52/588.1
3,668,184 A * 6/1972 Vogl ..... 428/36.9
3,855,132 A 12/1974 Dugan
4,841,686 A 6/1989 Rees
4,949,514 A 8/1990 Weller
5,038,530 A 8/1991 Watkins
5,242,591 A 9/1993 Beechert et al.
5,409,602 A 4/1995 Sorenson
5,535,554 A 7/1996 Harris Jr.
5,536,406 A 7/1996 Silva
(Continued)

FOREIGN PATENT DOCUMENTS

CA 2469378 A1 7/2005
(Continued)

OTHER PUBLICATIONS

GutterStuff™ Foam Filter Insert Internet site, last visited Feb. 20, 2004, 8 pages, Website: www.gutterstuff.com.

(Continued)

*Primary Examiner* — Nam Nguyen
*Assistant Examiner* — Denise R Anderson
(74) *Attorney, Agent, or Firm* — Reinhart Boerner Van Deuren P.C.

(57) ABSTRACT

A rain gutter filter apparatus and method utilize a filter element of a reticulated foam material adapted for insertion into a gutter having an open top defining a top width of the gutter. The filter element has a flat top surface with a width substantially matching the top width of the gutter, a bottom surface having a width less than the top width of the filter element, and front and rear surfaces extending upward from the bottom surface of the filter element to thereby form a front and a rear open passage for water on front and rear sides of the bottom surface of the filter element when the filter element is installed into the gutter. The reticulated foam material of the filter element has a composition that is flame resistant, germicidal, mold resistant, and resistant to degradation by exposure to ultraviolet rays.

33 Claims, 12 Drawing Sheets

U.S. PATENT DOCUMENTS

| | | | | |
|---|---|---|---|---|
| 5,658,637 | A * | 8/1997 | Volz | 428/95 |
| D395,072 | S | 6/1998 | Mariani | |
| 6,282,845 | B1 | 9/2001 | Hines | |
| 6,598,352 | B2 | 7/2003 | Higginbotham | |
| 6,732,477 | B1 | 5/2004 | Richard | |
| 6,932,911 | B1 | 8/2005 | Groth et al. | |
| 6,938,379 | B2 | 9/2005 | Groom | |
| 7,074,326 | B2 | 7/2006 | Singleton | |
| 7,208,081 | B2 | 4/2007 | Jones | |
| D550,804 | S | 9/2007 | Jones | |
| 7,310,912 | B2 | 12/2007 | Lenney et al. | |
| 7,740,755 | B2 | 6/2010 | Wilson et al. | |
| 7,752,811 | B1 | 7/2010 | Pavlansky | |
| 2002/0134029 | A1 | 9/2002 | Groom | |
| 2003/0046876 | A1 | 3/2003 | Higginbotham | |
| 2005/0034376 | A1 | 2/2005 | Pourdeyhimi et al. | |
| 2005/0145560 | A1 | 7/2005 | Jones | |
| 2005/0178072 | A1 | 8/2005 | Olthoff | |
| 2006/0037253 | A1 | 2/2006 | Mozeika, III | |
| 2009/0178366 | A1 | 7/2009 | Konkey | |

FOREIGN PATENT DOCUMENTS

| | | |
|---|---|---|
| WO | WO 2004/065718 A1 | 8/2004 |

OTHER PUBLICATIONS

U.S. Appl. No. 29/342,899, filed Sep. 2, 2009, Konkey.

Electronic Code of Federal Regulations, Title 49: Transportation, Section 571.302 Standard No. 302; Flammability of interior materials; date last visited May 13, 2011; pp. 1-4; page printed from a website http://ecfr.gpoaccess.gov/cgi/t/text/text-idx?c=ecfr&sid=7b0c32536445818d98cb0db380d . . . .

U.S. Department of Transportation, National Highway Traffic Safety Administration, Laboratory Test Procedure for FMVSS 302, Flammability of Interior Materials; Oct. 18, 1991; 32 pp., cover p., table of contents, and pp. 1-30; Safety Assurance, Office of Vehicle Safety Compliance, Washington, DC 20590, USA.

* cited by examiner

GUTTER FILTER

CROSS-REFERENCE TO RELATED PATENT APPLICATIONS

This patent application is a continuation-in-part of co-pending U.S. patent application Ser. No. 12/061,419, filed Apr. 2, 2008, which is a continuation-in-part of U.S. patent application Ser. No. 11/107,770, filed Apr. 15, 2005, which is now abandoned, and claims the benefit of U.S. Provisional Patent Application No. 60/562,649, filed Apr. 15, 2004, the entire teachings and disclosures of which are incorporated herein by reference thereto.

FIELD OF THE INVENTION

This invention relates to rain gutters attached to the edge of a roof, and more particularly to an apparatus for preventing leaves and other debris from entering such rain gutters.

BACKGROUND OF THE INVENTION

There are many devices on the market that can be attached to a rain gutter for preventing leaves and other debris from entering the gutter. Some of these devices utilize a foam filter insert, formed from an open-cell material, that is inserted into the gutter. Such foam inserts typically have a top surface that totally closes off the top opening of the gutter so that leaves and other debris from the roof slide across the top surface without entering the gutter, while the water from the roof flows through the foam insert and into the gutter.

In U.S. Pat. No. 3,855,132 to Dugan, a filler element made of a porous foam material, and having a sloped top surface, is inserted into a gutter, so that water cascading into the gutter from a sloped roof, and carrying foreign debris from the roof, flows across the sloped top surface of the foam insert. The water flows through the foam in a vertical direction and then along the gutter in a horizontal direction to a downspout or other device for exit from the gutter. The debris is trapped on the surface of the foam filler and either dries and is blown away or is brushed off of the surface of the foam filler.

Dugan discloses embodiments wherein the foam filler occupies the entire volume defined by the gutter walls, and other embodiments where a space or open-passageway is left between the foam filler and the bottom of the gutter, so as to allow for a freer flow of liquid below the porous section of the foam filler while still achieving the debris blocking advantages of the porous nature of the foam filler. Dugan discloses that such an open-passageway configuration may be achieved by forming the filler with a precut slot on it's lower side, or by forming the filler in a size smaller than the depth of the gutter and providing spaced support along the length of the gutter to support the filler and to maintain the open passageway between it and the bottom of the gutter.

Dugan further discloses the use of a porous foam, preferably of a polyurethane variety, with a suitable foam providing a 95% void volume with an average of 10 pores per lineal inch.

U.S. Pat. No. 4,949,514 to Weller, discloses a liner for a rain gutter comprising a body of porous solid material which is installed in the gutter to form an upper barrier surface. The barrier surface has a plurality of undulations. Longitudinally extending projections at the side portions of the body function as sealing structures to seal the liner with the gutter sidewalls. The liner and gutter form a single lower longitudinally extending liquid passageway. Liquid passes through the liner to the passageway, while debris remains on the upstream side of the barrier surface. Weller also discloses that a gutter liner, in accordance with his invention, may be composed of polyurethane foam or other similar materials.

Other types of foam gutter fillers and inserts are also known which are fabricated from a polyether material.

Prior foam gutter filter inserts suffer from several significant problems, however. Some prior foam filter inserts have been shown to have inadequate fire resistance. This is particularly true for prior foam inserts made from polyether material which is not fire resistant, and is therefore readily ignited by sparks from burning leaves or fireplaces. Polyether material also has a tendency to form a hard crust on the top surface, due to exposure to sunlight and the environment. When the hard crust forms, the color of the foam insert changes from a dark color that is conducive to melting snow and ice when warmed by the sun, to a light color which does not effectively melt snow and ice when exposed to the sun. Materials used in prior foam gutter inserts also do not provide resistance to mold, and are not germicidal, factors which lead to reduced performance and unacceptably shortened operating life of the insert.

The ability of prior foam gutter inserts to pass an adequate amount of water during a heavy rain, and to allow a sufficient volume of water to flow through the gutter beneath the foam insert, to avoid overflowing the gutter, is less than adequate. In addition, the cross-sectional shapes of prior foam gutter filters are not conducive to fitting readily within standard gutter shapes, and do not provide sufficient structural stability to avoid being tipped over or deformed during a heavy rain, or where snow and ice may have built up on the edges of the roof.

What is needed, therefore, is an improved foam gutter filter for preventing leaves and debris from entering the gutter, overcoming one or more of the problems described above.

BRIEF SUMMARY OF THE INVENTION

The invention provides an improved rain gutter filter apparatus, for insertion in a gutter having an open top defining a top width of the gutter, through use of a filter element of a reticulated foam material having a flat top surface thereof with a width substantially matching the top width of the gutter, a bottom surface having a width less than the top width, and front and rear surfaces thereof extending upward from the bottom surface, to thereby form a front and rear open passage for water on the front and rear sides of the bottom surface when the filter element is installed into the gutter.

The front and rear sides may include portions thereof which are angled or curvilinear in shape and orientation with respect to the bottom surface.

A filter apparatus, according to the invention, may include multiple filter elements adapted to be disposed end to end with one another in the gutter.

In one form of the invention, a gutter filter element is comprised of a reticulated foam having a composition that is flame resistant, germicidal, mold resistant, and resistant to degradation by exposure to ultraviolet rays. The reticulated foam may provide a cell count in the range of 20 to 40 cells per inch. In some forms of the invention, the reticulated foam material may provide a cell count of approximately 30±6 cells per inch.

In some forms of the invention, a filter element may be configured to balance on the bottom surface of the filter element, when the bottom surface is supported on a horizontal surface.

In some forms of the invention, a filter element may be configured for compressible insertion across a top surface of the gutter, and configured to be supported by gutter hangers extending through a cut in the gutter filter.

In some forms of the invention, a filter element may have a top surface thereof which is inclined in such a manner that a rear edge of the top surface closely abuts the shingles or other roofing material covering the roof, with the upper surface sloping downward away from the edge of the roof to the front edge of the gutter, to thereby facilitate debris washing across the top of the filter element.

In some forms of the invention, a filter element may be configured to have a T-shaped cross-section, with a top portion of the T being configured for compressible insertion across the top of the gutter, with the T-shaped cross-section further defining a stiffening and rib-like support leg portion extending downwardly from the top of the filter element into the gutter, when the top of the gutter filter is installed across the opening at the top of the gutter. In some forms of the invention, the downwardly-extending leg has a bottom surface thereof which contacts a bottom surface of the gutter, to provide additional support for the filter element in the gutter. In other embodiments of the invention, the bottom surface of the downwardly-extending leg is suspended above the bottom surface of the gutter, but still serves to define a front and a rear open passage for water on the front and rear sides respectively of the downwardly-extending leg.

The invention may also take the form of a method for installing a rain gutter filter apparatus according to the invention. A method, according to the invention, may include installing the filter element into the gutter prior to attaching the gutter to a roof.

In various forms of the invention, a gutter filter apparatus or method according to the invention, provides one or more of the following properties and advantages:

A no clog filtering membrane with a high porosity rate having no capability of clogging and or impeding the flow of rainwater.

A product that sheds water like a sieve, with completely open pores that permit extremely rapid drainage (in excess of 20" of rainfall per hour) permitting maximum water drainage and air circulation for fast drying. Less than 15 percent of the water is retained in the foam, and evaporates within a relatively short period of time.

Falling debris, tree limbs, seedpods, high winds, maple tree helicopters, snow or ice will not damage this product. The no clog filtering membrane resists the build up of snow and ice formations inside the gutter.

A fibrous membrane with a characteristic heat absorbent dark color, which enhances the natural process of the melting of snow or ice.

A product with form fit and function allowing no impedance into the existing roofing structure. A product installed under the existing gutter brackets that provides full enclosure of the gutter surface.

An assembly of elongated pads of fibrous material mounted flush on the inside of a gutter system extending the length and width of said gutter extraction system. Protecting the roof warranty uses no nails, screws or hardware of any kind in the installation process.

A product that completely fills and seals the top of the gutter with a flush fit preventing any accumulation of foreign debris inside the gutter that would impede the flow of water.

Proper installation presents a product presentation invisible from ground level and worry free from damage from falling debris.

A UV stabilizer has been added to stabilize and inhibit material break down from ultraviolet light.

A product with a built in Germicidal Additives to inhibit Microbiological growth such as, fungus and mildew inside the gutter system.

The extremely high filtration rate virtually eliminates the mosquito threat posed by standing water, for properly installed gutters.

The no clog filtering membrane installed inside the gutter eliminates nesting areas for bees, wasp's hornets and birds.

This filtering membrane eliminates the need to clean a gutter of accumulating debris, because debris will not clog or pass thru the membrane to accumulate and eventually clog a gutter. No preventative maintenance is required with this product. This product helps eliminate the damage caused by wet debris and standing water trapped by debris in the gutter system.

The high porosity rate of the no clog filtering membrane will help eliminate the overflowing of rainwater over the edge of the existing gutter system. The highest rates of rainfall are accepted into the gutter system and are directed to the downspout for fast and efficient water extraction.

The filtering membrane is easily installed and can be removed and reinstalled, as circumstances require.

Other aspects, objectives and advantages of the invention will become apparent from the following detailed description, taken in conjunction with the accompanying drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
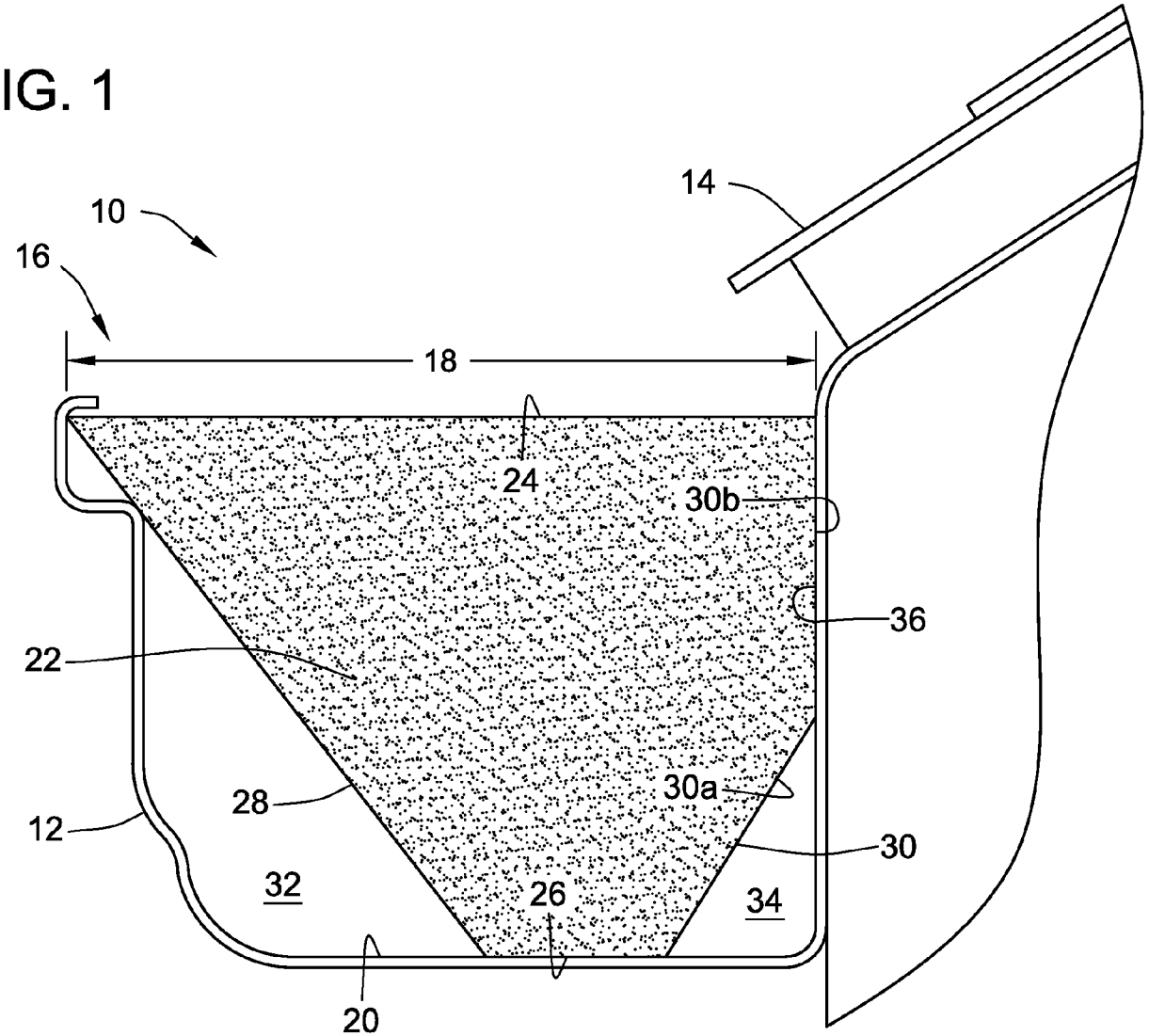
FIG. 1 is a cross-sectional view of a rain gutter, attached to a sloped roof, and having installed therein a rain gutter filter apparatus according to the invention.

FIG. 1 shows a first exemplary embodiment of a rain gutter filter apparatus 10, according to the invention, for insertion into a gutter 12 attached to a sloped roof 14. The gutter 12 includes an open top 16 defining a top width 18 of the gutter 12. The gutter 12 further defines a flat bottom surface 20 thereof.

Figure 2:
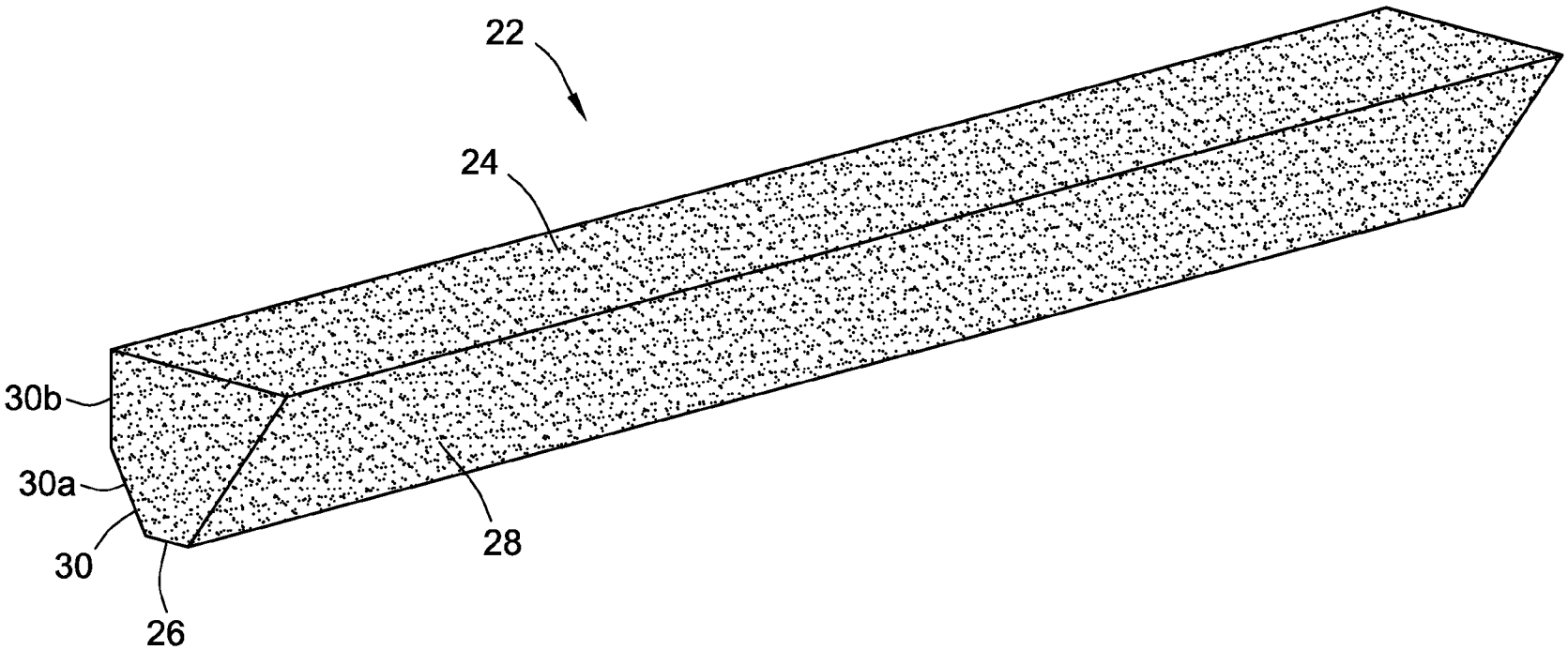
FIG. 2 is a perspective view of the exemplary filter element of FIG. 1, prior to installation of the filter element into the gutter.
Figure 3:
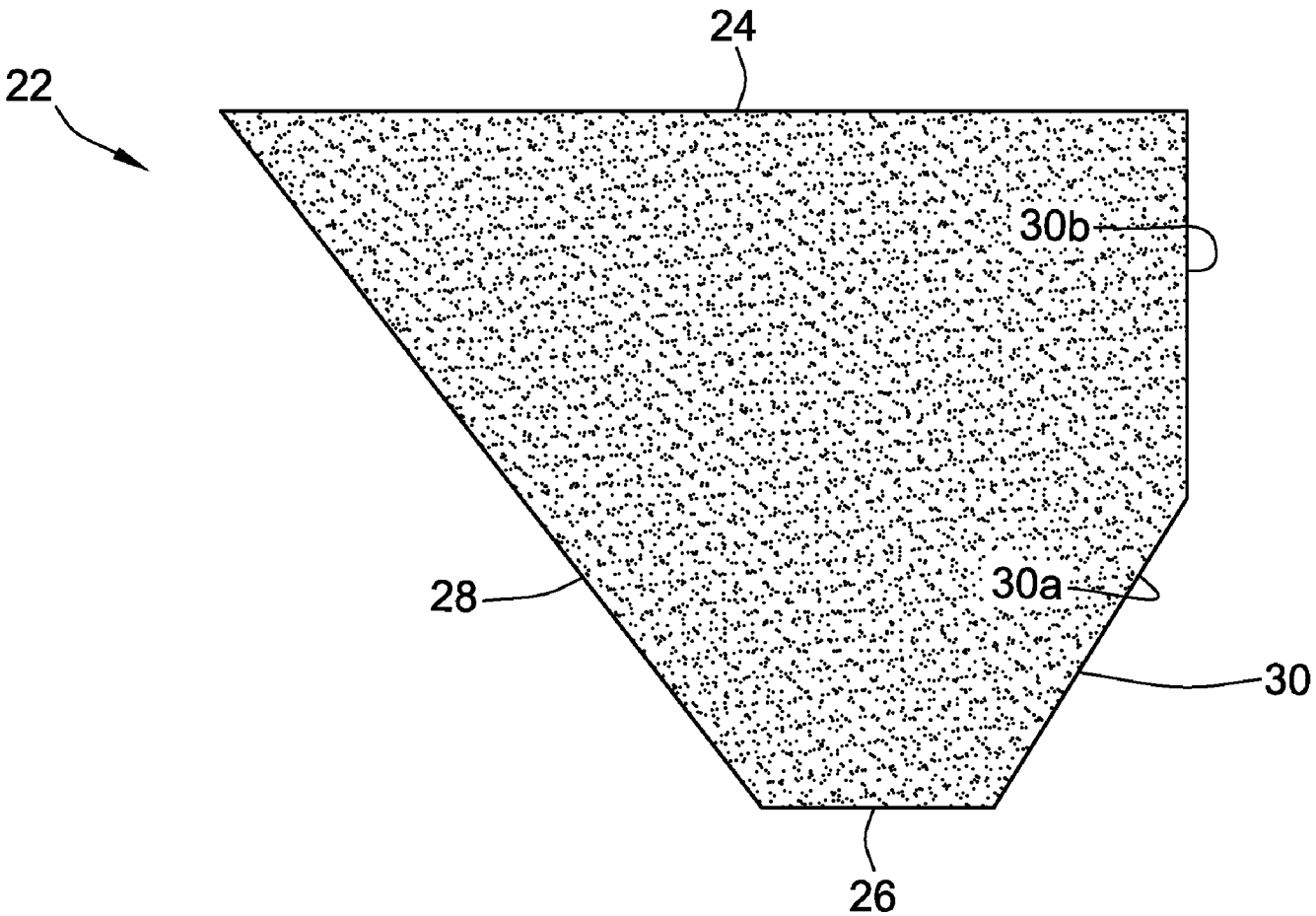
FIG. 3 is a cross-sectional view of the filter element shown in FIGS. 1 and 2.

As shown in FIGS. 1-3, the filter apparatus 10 includes a filter element 22 of reticulated foam material, having a flat top surface 24, with a width substantially matching the top width 18 of the gutter 12. The first exemplary embodiment of the filter element 22 also includes a flat bottom surface 26, having a width less than the top width of the filter element 22, and front and rear surfaces 28, 30 extending upward from the bottom surface 26, to thereby form a front and a rear open passage 32, 34 for water to the front and rear of the bottom surface 26, when the filter element 22 is installed into the gutter 12 with the top surface 24 of the filter element 22 extending completely across the open top width 18 of the gutter 12, and the bottom surface 26 of the filter element resting on the bottom surface 20 of the gutter 12.

As shown in FIG. 2, in the first exemplary embodiment of the rain gutter filter apparatus 10, the filter element is formed by an appropriate method, such as hot-wire cutting, to form the various surfaces described above, and to a convenient length, such as 48". In the first exemplary embodiment of the rain gutter filter apparatus 10, multiple filter elements 22 are disposed end to end with one another in the gutter 12, to provide protection against the entry of foreign debris into the gutter along the entire length of the gutter. In other embodiments of the invention, however, it may be desirable to provide a filter element, in accordance with the invention, in the form of an elongated rolls for insertion into the gutter 12. It is also contemplated, that in some embodiments of the invention, a filter element according to the invention may be installed into the gutter 12, prior to attaching the gutter 12 to the roof 14.

In the first exemplary embodiment of the filter element 22, the front surface 22 of the filter element angles upward to join the front end of the top surface of the filter element, whereas the rear surface 30, includes a first angled portion 30*a* and a second vertical portion 30*b* thereof. In other embodiments of the invention, the front and rear surfaces 28, 30 of the filter element 22 may take other forms, but in any event it is preferred that, whatever form the front and rear surfaces 28, 30 might take, that the filter element 22 have a center of gravity positioned such that the filter element will balance on the bottom surface 26, when the bottom surface 26 is supported on a horizontal surface, such as the bottom surface 20 of the gutter 12. (See, for example, FIGS. 4-9). With the filter element 22 configured in this manner, to balance on the bottom surface 26, stability of the filter element within the gutter 12 is significantly improved, in comparison to prior foam gutter fillers. In addition, in embodiments of a filter element 22 according to the invention having a portion 30*b* of the rear surface 30 oriented substantially perpendicular to the bottom surface 26, and configured to bear against a rear surface 36 of the gutter 12, the filter element 22 exhibits a very high stability within the gutter 12, while still providing substantially more space for flow of water through the gutter in the front and rear open passages 32, 34, as compared to prior foam gutter fillers.

In a preferred embodiment of a rain gutter filter apparatus 10, according to the invention, the filter element 22 is comprised of a reticulated foam having a composition that is flame resistant, germicidal, mold resistant, and resistant to degradation by exposure to ultraviolet rays. One foam product meeting such requirement is a reticulated graft polyether foam marketed under the trade name EZ-DRI 1835UV, by Crest Foam Industries, Inc., of Moonachie, N.J. The EZ-DRI 1835UV material, preferred in practicing the invention, has a nominal density of 1.8 lbs/cu.ft. and an IPD of 28, and is manufactured with a UV stabilizer package. In a preferred embodiment of the invention, a filter element, according to the invention, is wire cut from buns of the EZ-DRI 1835UV material. Additional properties of the EZ-DRI 1835UV material are tabulated below.

SPECIFICATION FOR EZ-DRI 1835UV

| Property | Value | Method |
|---|---|---|
| Density | 1.8 +/− 0.10 | ASTM D 3574-91 |
| Compression Set @ 50% Deflection | 20% loss, max. | ASTM D 3574-91 |
| 25% CFD | Not Specified | NA |
| 25% IFD | 26 ± 6 | ASTM D 3574-91 |
| 55% IFD | Not Specified | ASTM D 3574-91 |
| Sag Factor | 1.8 nominal | ASTM D 3574-91 |
| 25% CLD Autoclave Loss | 26%, max. | ASTM D 8574-91 |
| Compression Set @ 50% Deflection Autoclave Loss | 10%, max. | ASTM D 3571-91 |
| Tensile Strength | 20 ± 4 lb./in. min. | ASTM D 3874-91 |
| Tensile Strength Dry Heat Loss | 15%, max. | ASTM D 3874-91 |
| Elongation @ Break | 150%, min. | ASTM D 3574-81 |
| Tear Strength | 5.0 lb/in. min. | ASTM D 3574-91 |
| Volumetric Air Flow Rate | 14 ± 3.0 ctm | ASTM D 3574-91 |
| FR Classification | FMVSS 302 | FMVSS-302 |
| Germicidal Additive | UltraFresh | NA |
| UV Stabilizer | Yes | |

It is desirable to form a filter element, according to the invention from a reticulated foam material having a dark color, such as black, charcoal, or dark brown, to facilitate absorption of ultraviolet rays for melting snow and ice off of the gutter filter. In general, the gutter filter material is not visible from the ground once it is install within the gutter. For aesthetic purposes, however, in applications where the filter element may be observed from an upper floor above the gutter, other embodiments of a gutter filter, according to the invention, may be formed from a reticulated foam having colors other than those which would be most conducive to absorption of ultraviolet rays.

Those having skill in the art will appreciate, that the preferred material for fabricating a filter element, according to the invention, meets the flame resistance standards of FMVSS 302. No prior foam gutter filler meets such stringent standards for fire resistance.

In fact, the present invention has achieved considerable commercial success due in part to the flame resistant standards of filter elements constructed in accordance with the invention to meet flame resistant standards such as FMVSS 302. Customers have provided the inventor of the present invention with testimonial evidence stating that they have removed prior foam gutter filter products, and replaced them with filter elements according to the invention, solely on the basis of the results of independent flame testing performed by the customer comparing, side-by-side, the prior foam gutter filter products with a filter element according to the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the herein-described elements in all possible variations thereof is encompassed by the invention unless otherwise indicated herein or otherwise clearly contradicted by context.

Figure 4:
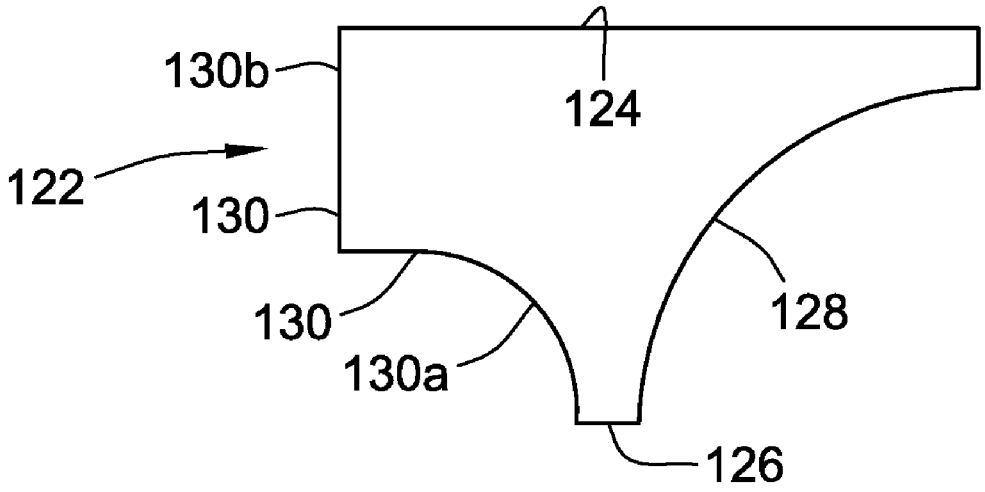
FIGS. 4 and 5 are cross-sectional views of alternate embodiments of filter elements, according to the invention, having curved front and rear surfaces.
Figure 5:
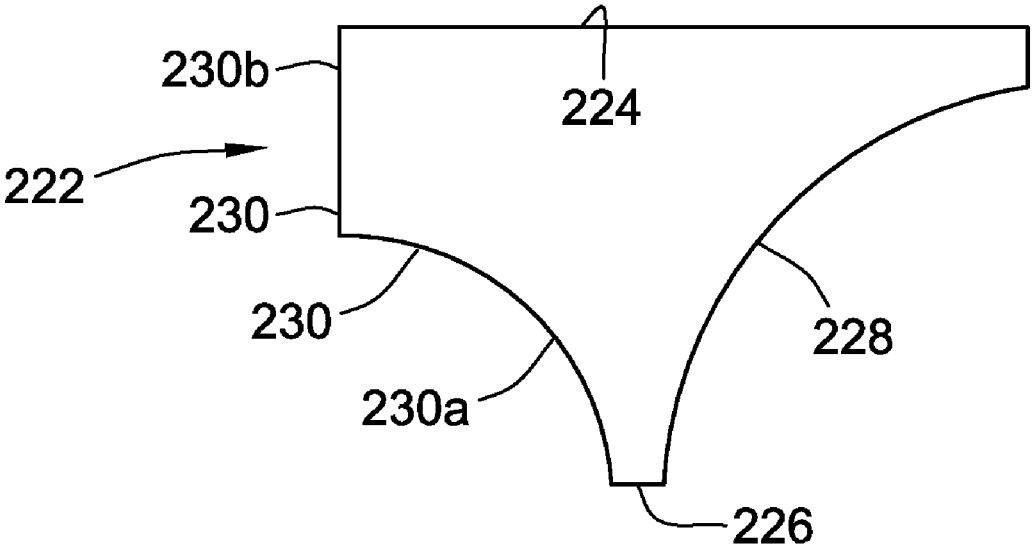

For example, FIGS. 4 and 5, respectively, show additional exemplary embodiments of filter elements 122, 222 of reticulated foam material, including flat top surfaces 124, 224 having a width substantially matching the top width of a gutter (not shown) into which the filter element is to be installed. The exemplary embodiments of the filter elements 122, 222 also include a flat bottom surface 126, 226 having a width less than the top width of the filter elements 122, 222, and front and rear surfaces (128, 130) (228, 230) extending upward from the bottom surfaces 126, 226 to thereby form front and rear open passages for water to the front and rear of the bottom surfaces 126, 226 when the filter element 122, 222 are installed into a gutter with the top surfaces 124, 224 of the filter element 122, 222 extending completely across the open top width of the gutter, and the bottom surface 126, 226 of the filter element 122, 222 resting on the bottom surface of the gutter. It will be noted that in the filter elements 122, 124 shown in FIGS. 4 and 5, the front surfaces 128, 228 and a portion 130*a*, 230*a* of the rear surfaces 130, 230 respectively are curvilinear in shape, rather than being straight angled sides as was the case in the first exemplary embodiment of the filter element 22 shown in FIGS. 1-3.

Figure 6:
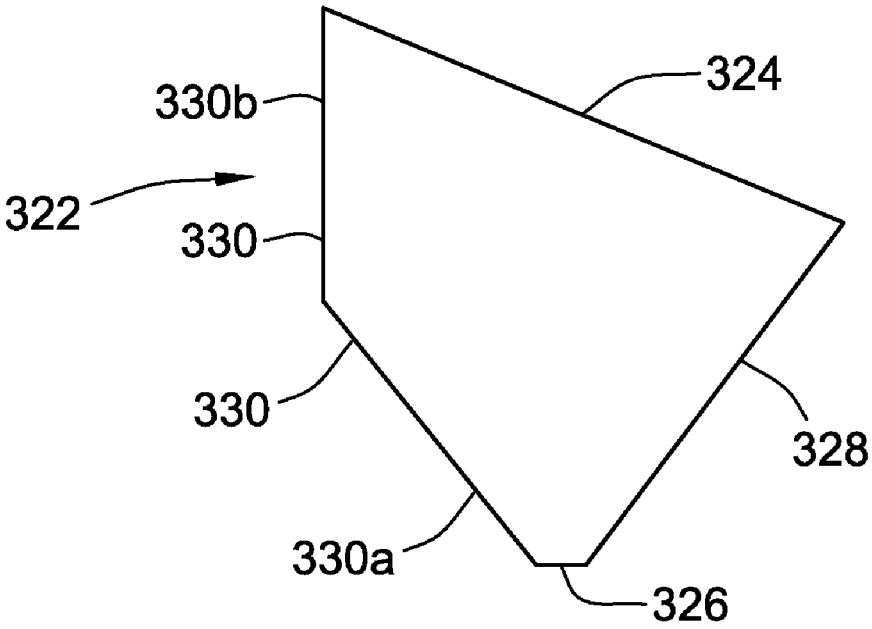
FIGS. 6 and 7 are cross-sectional views of embodiments of filter elements, according to the invention, having sloped top surfaces.
Figure 7:
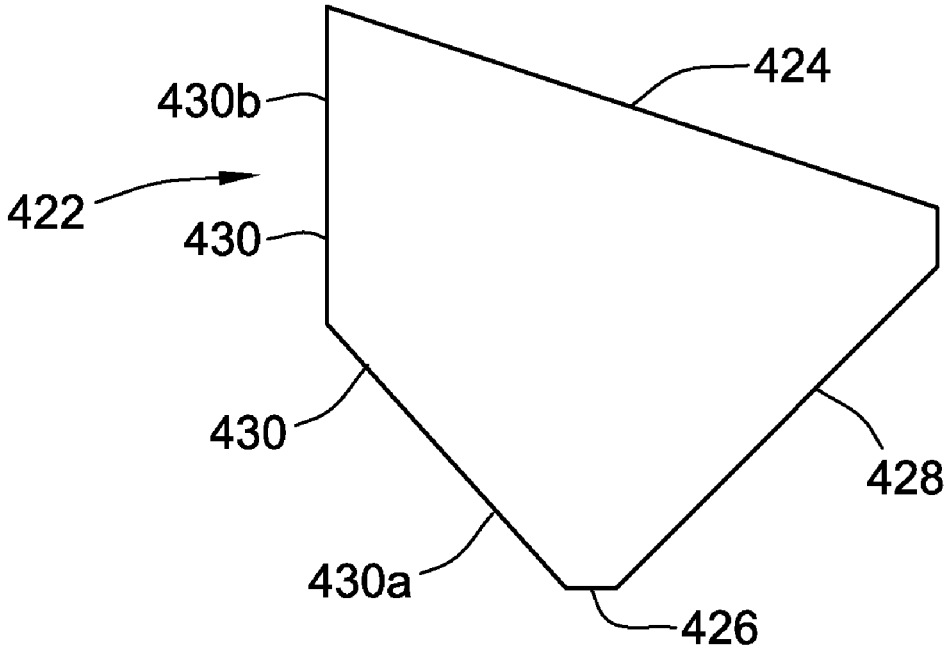

FIGS. 6 and 7, respectively, show additional exemplary embodiments of filter elements 322, 422 of reticulated foam material, including flat top surfaces 324, 424 having a width substantially matching the top width of a gutter (not shown) into which the filter element is to be installed. The exemplary embodiments of the filter elements 322, 422 also include a flat bottom surface 326, 426 having a width less than the top width of the filter elements 322, 422, and front and rear surfaces (328, 330) (428, 430) extending upward from the bottom surfaces 326, 426 to thereby form front and rear open passages for water to the front and rear of the bottom surfaces 326, 426 when the filter element 322, 422 are installed into a gutter with the top surfaces 324, 424 of the filter element 322, 422 extending completely across the open top width of the gutter, and the bottom surface 326, 426 of the filter element 322, 422 resting on the bottom surface of the gutter. It will be noted that in the filter elements 322, 324 shown in FIGS. 4 and 5, the front surfaces 328, 428 and a portion 330*a*, 430*a* of the rear surfaces 330, 430 respectively are straight angled sides as was the case in the first exemplary embodiment of the filter element 22 shown in FIGS. 1-3. It will be further noted that the top surfaces 324, 424 are sloped with respect to the bottom surfaces 326, 426 and the bottom of the gutter 12, as shown in FIG. 10.

Figure 8:
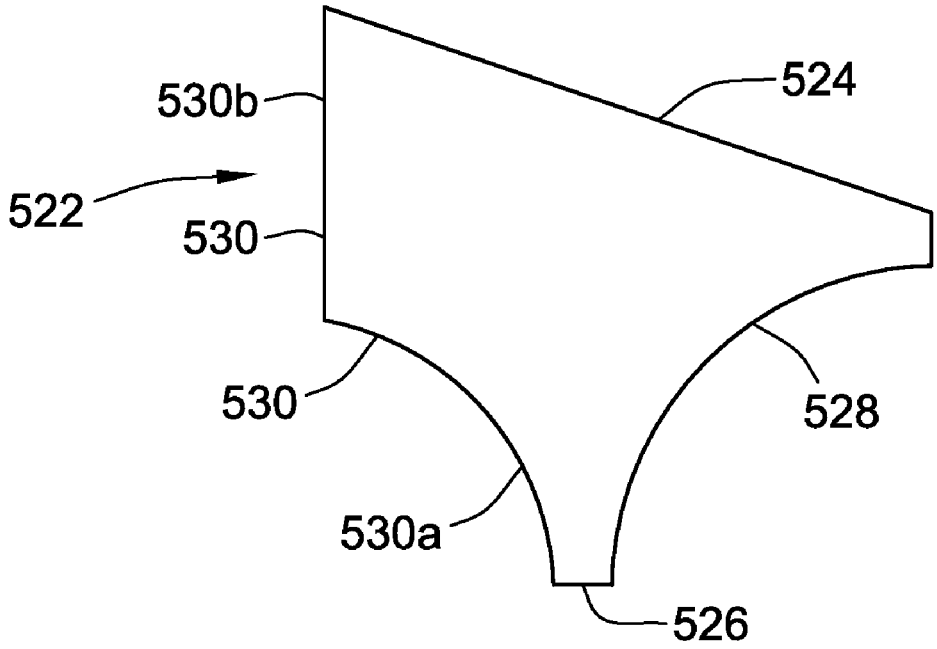
FIGS. 8 and 9 are cross-sectional views of exemplary embodiments of filter elements, according to the invention, having curved front and rear surfaces and sloped top surfaces.
Figure 9:
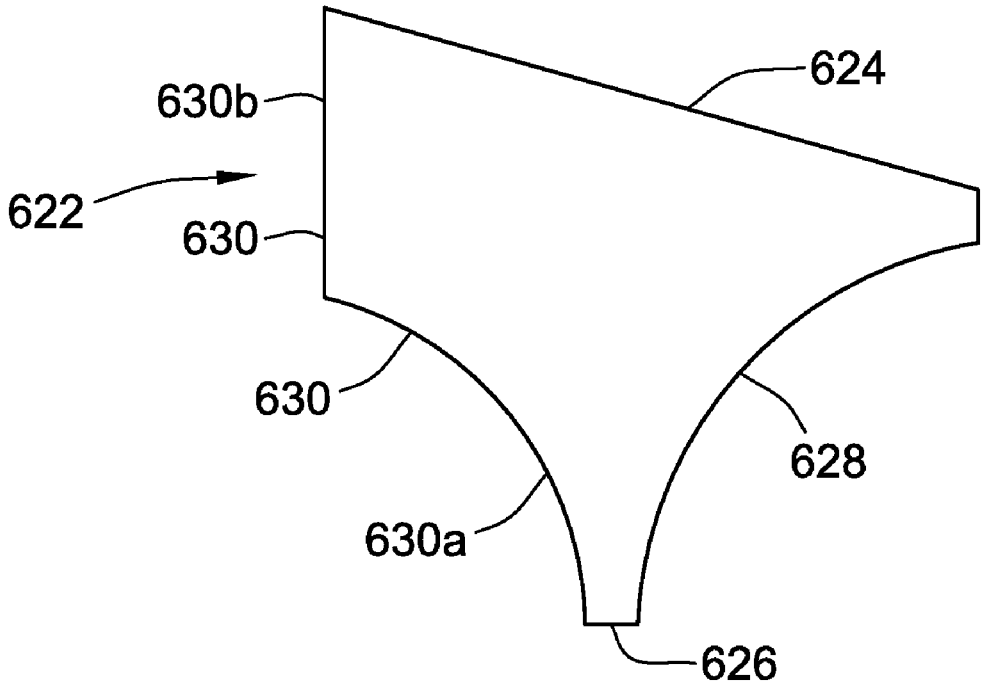

FIGS. 8 and 9, respectively, show additional exemplary embodiments of filter elements 522, 622 of reticulated foam material, including flat top surfaces 524, 624 having a width substantially matching the top width of a gutter (not shown) into which the filter element is to be installed. The exemplary embodiments of the filter elements 522, 622 also include a flat bottom surface 526, 626 having a width less than the top width of the filter elements 522, 622, and front and rear surfaces (528, 530) (628, 630) extending upward from the bottom surfaces 526, 626 to thereby form front and rear open passages for water to the front and rear of the bottom surfaces 526, 626 when the filter element 522, 622 are installed into a gutter with the top surfaces 524, 624 of the filter element 522, 622 extending completely across the open top width of the gutter, and the bottom surface 526, 626 of the filter element 522, 622 resting on the bottom surface of the gutter. It will be noted that in the filter elements 522, 524 shown in FIGS. 4 and 5, the front surfaces 528, 628 and a portion 530*a*, 630*a* of the rear surfaces 530, 630 respectively are curvilinear in shape, rather than being straight angled sides as was the case in the first exemplary embodiment of the filter element 22 shown in FIGS. 1-3, and the top surfaces 524, 624 are sloped.

Figure 10:
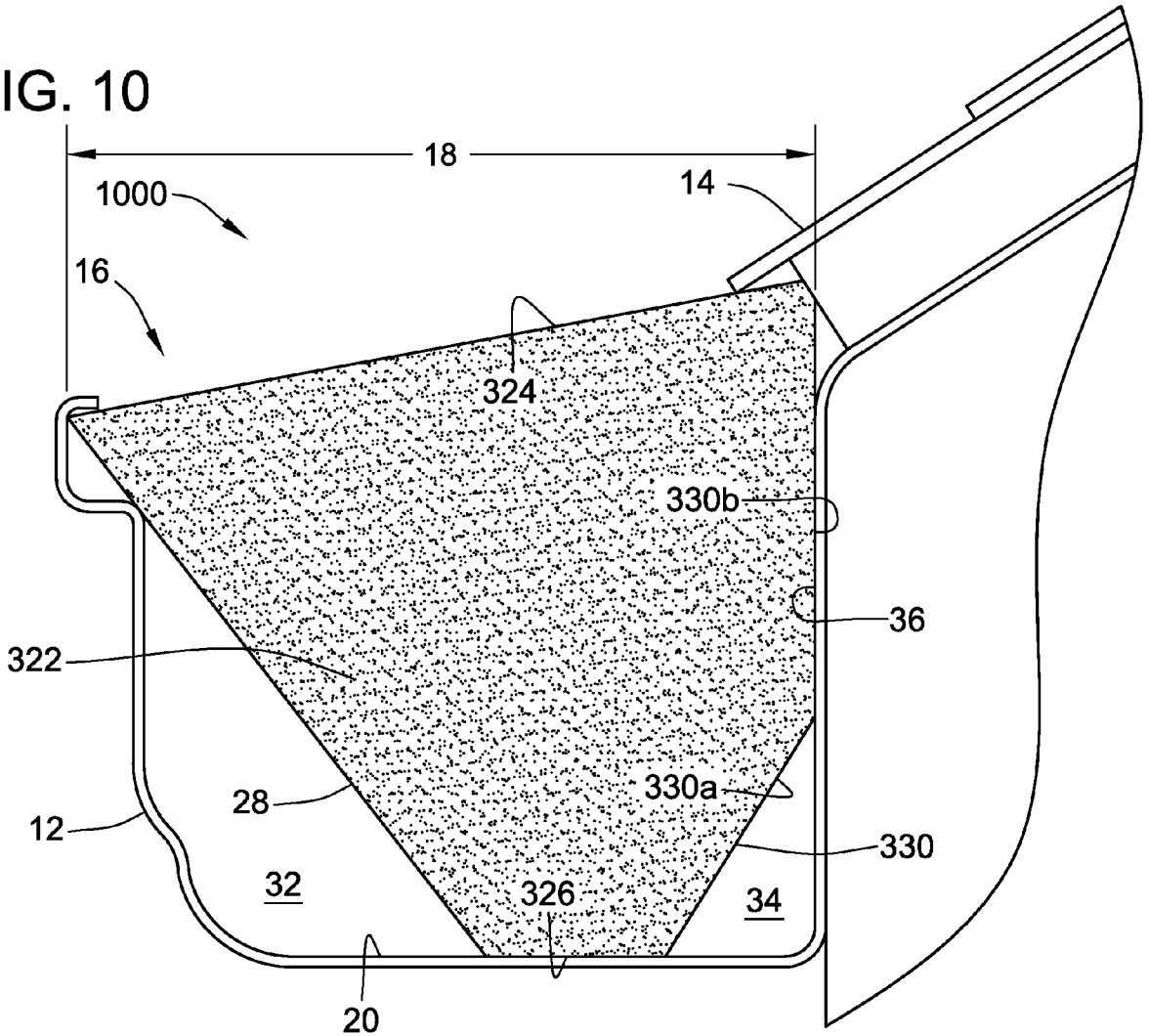
FIG. 10 is a cross-sectional view of the rain gutter and sloped roof, shown in FIG. 1, having a gutter filter similar to the embodiment shown in FIG. 6 installed in the rain gutter.

FIG. 10 shows a second exemplary embodiment of a rain gutter filter apparatus 1000, according to the invention, which is essentially identical to the first exemplary embodiment of the rain gutter filter apparatus 10, as described above with reference to FIG. 1, with the exception that in the second exemplary embodiment 1000 a filter element 322, substantially as shown in FIG. 6, having a sloped upper surface 324 is installed in the gutter 12. As shown in FIG. 10, the sloped upper surface 324 extends upward to a point of substantial contact with the sloped roof 114, to thereby provide additional impetus to leaves, or other debris being washed off of the roof 14, to more readily be washed off of the top surface 324 of the filter element 322.

Figure 12:
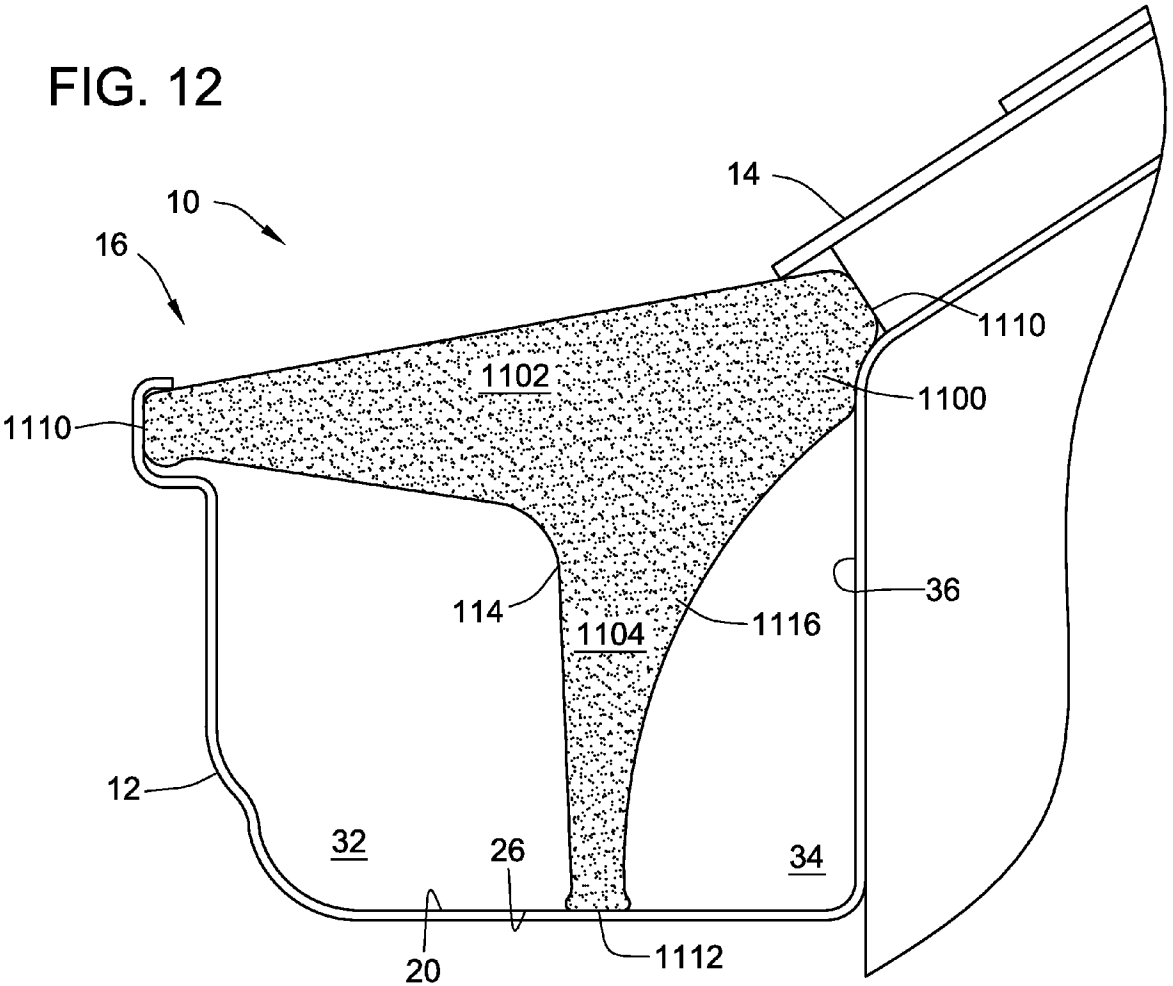
FIGS. 12-14 are schematic illustrations of three installations showing the T-shaped gutter filter apparatus of FIGS. 11A-11F installed in a gutter.
Figure 13:
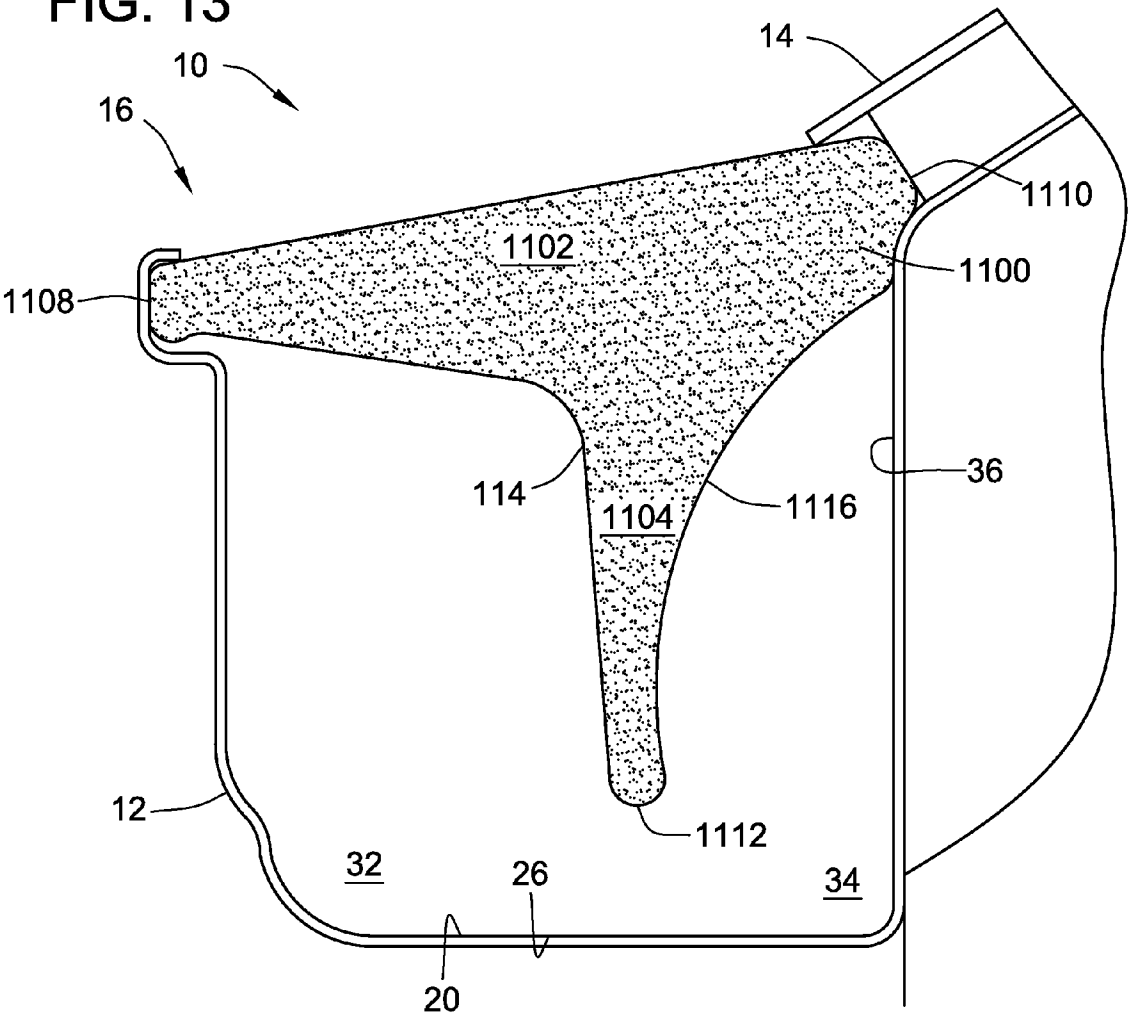
Figure 14:
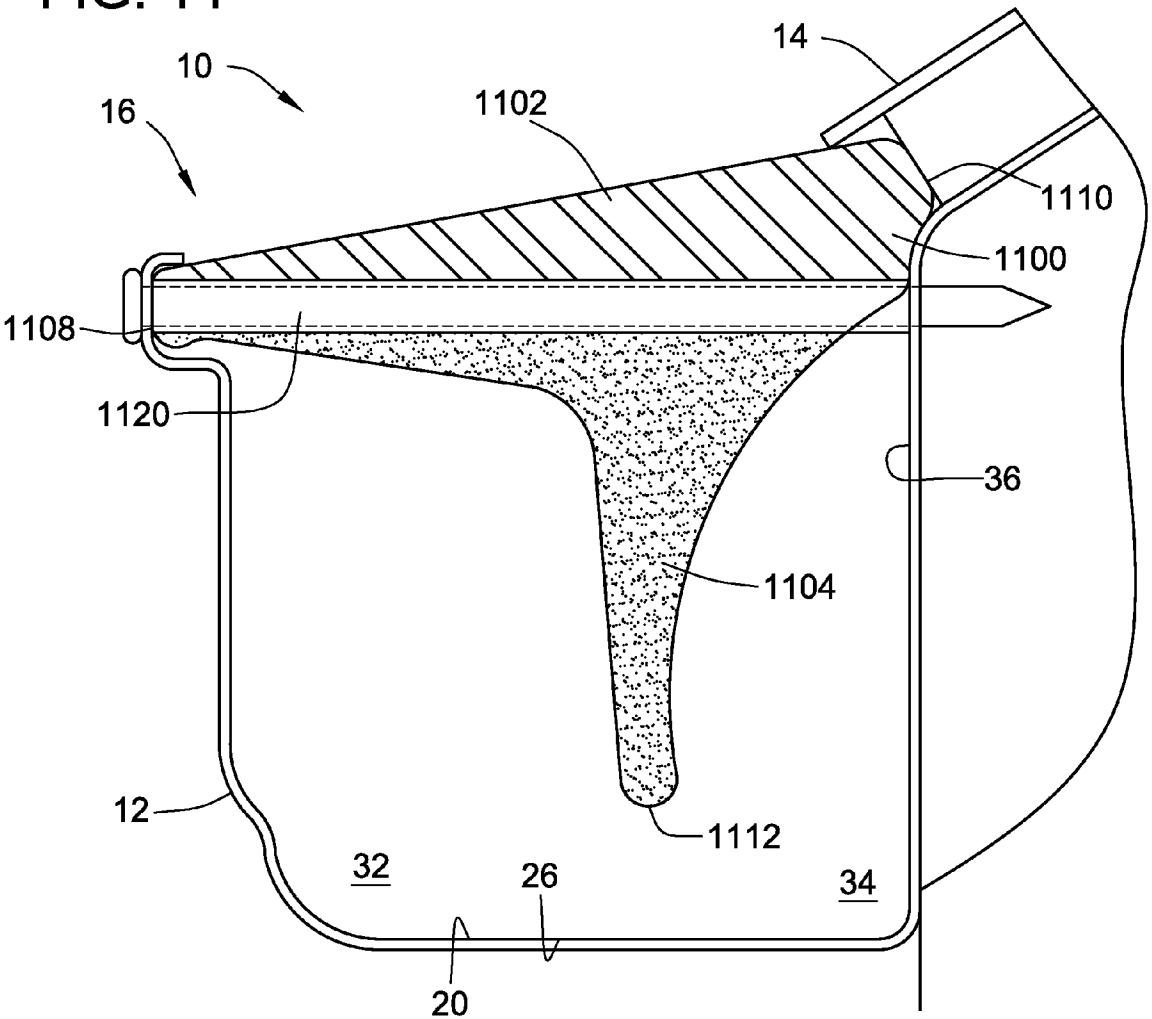
Figure 15A:
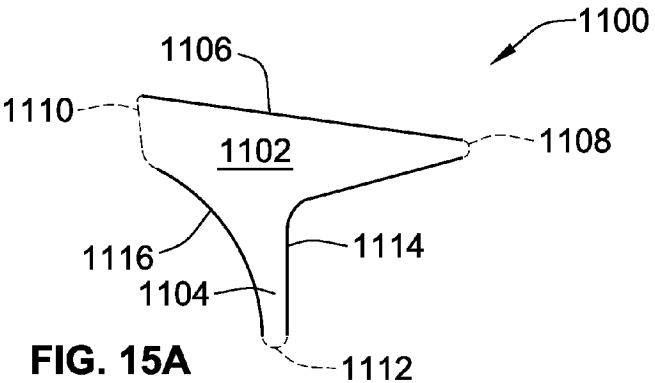
FIGS. 15A-15F illustrate a variation of the T-shaped gutter filter apparatus of FIGS. 11A-11F, showing that three corner areas of the T-shaped apparatus may have a variety of alternate configurations and shapes, in accordance with the invention.
Figure 15B:
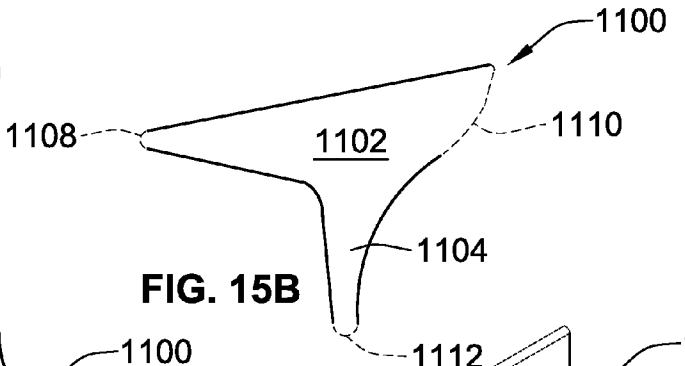
Figure 15F:
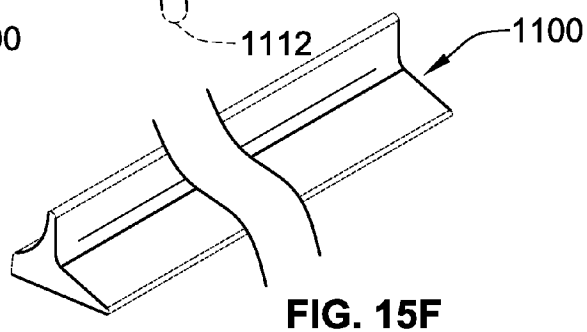
Figure 15C:
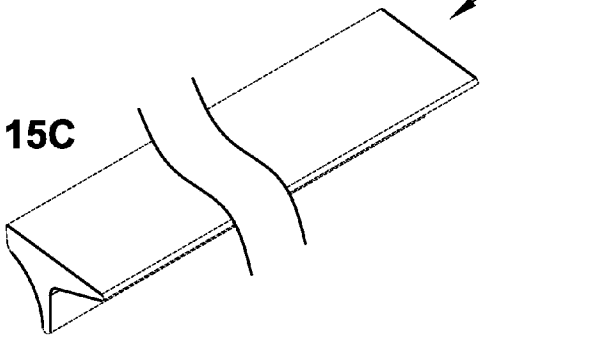
Figure 15D:
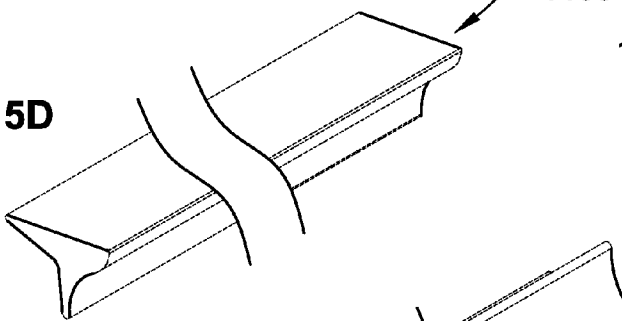
Figure 15E:
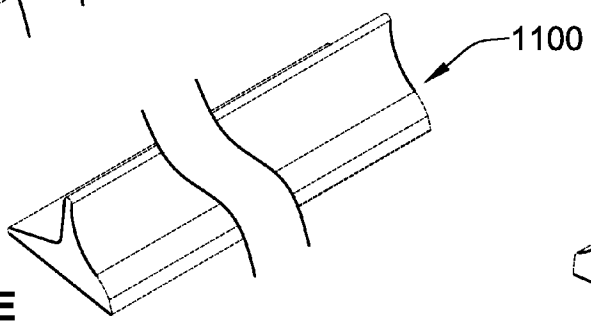

FIGS. 11A-11F, show a T-shaped exemplary embodiment of a rain gutter filter apparatus 1100, according to the invention. FIGS. 12-14 show the T-shaped exemplary embodiment of the rain gutter filter apparatus 1100 installed in a gutter 12.

Figure 11A:
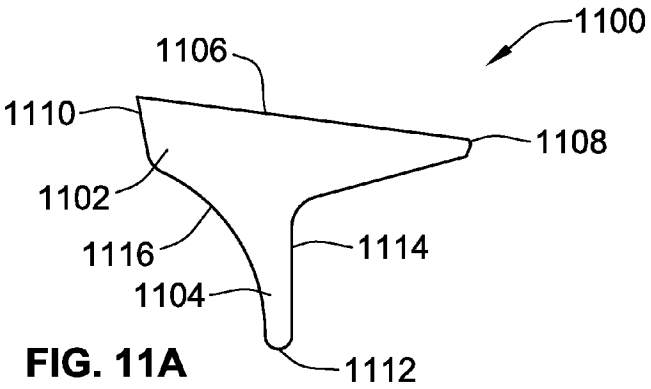
FIGS. 11A-11F are orthographic first and second end views, and several perspective views of a T-shaped gutter filter apparatus, according to the invention.
Figure 11B:
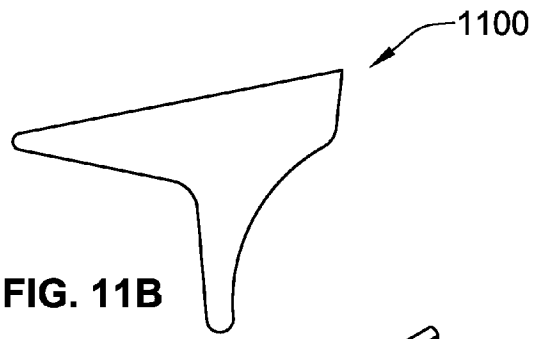
Figure 11F:
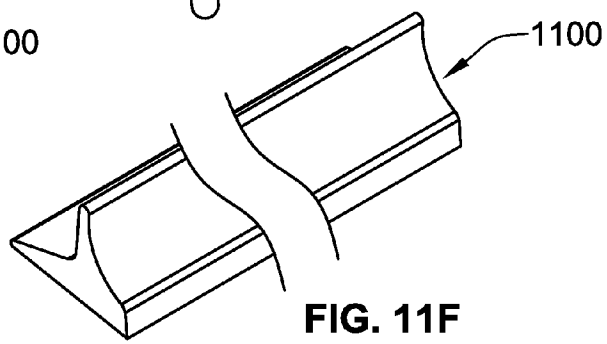
Figure 11C:
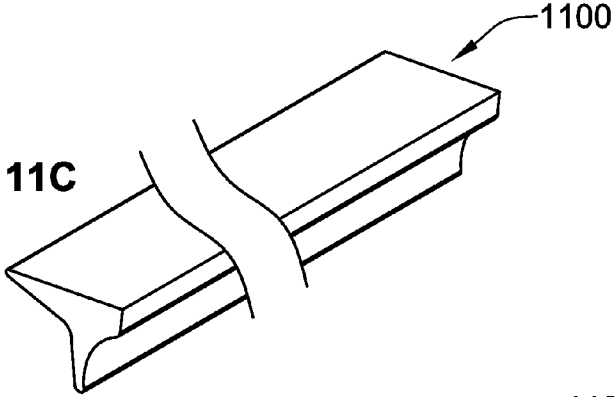
Figure 11D:
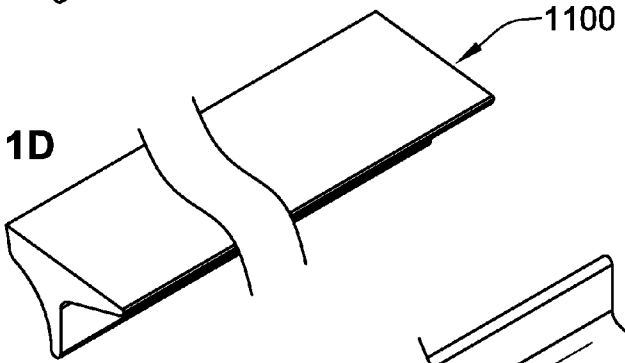
Figure 11E:
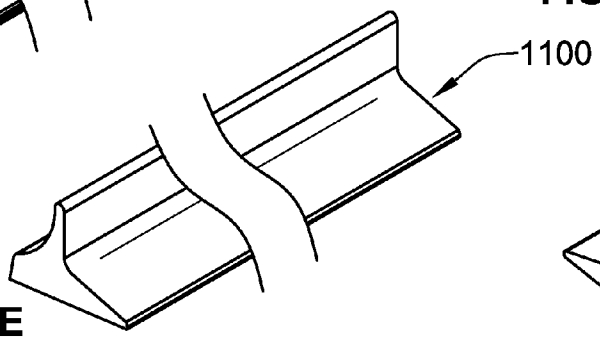

As shown in FIG. 11A, the T-shaped gutter filter apparatus 1100 has a top portion 1102 and a downwardly-extending rib portion 1104. The top portion 1102 of the rain gutter insert 1100 includes the top surface 1106 of the gutter insert 1100, and has front and rear corner portions 1108, 1110 thereof which are configured to interface compressively with the gutters 12 and at a front corner 1108 of the top portion 1102, and with the gutter and/or a portion of the roof or building structure at the rear corner 1110 of the upper portion 1102.

The downwardly-extending rib portion 1104 of the gutter filter apparatus 1100 is defined by the bottom surface 1112 and the front and rear surfaces 1114, 1116 of the T-shaped gutter filter apparatus 1100. As shown in FIGS. 11A-11B, and FIGS. 12-14, the T-shaped gutter filter apparatus 1100 has a sloped upper surface 1106, and curvilinear front and rear surfaces 1114, 1116. It will be understood, by those having skill in the art, that in other embodiments of the invention a T-shaped filter apparatus, according to the invention, may have a top surface 1106 which is not flat and either or both of the front and rear surface 1114 and 1116 may be angled rather than curvilinear as illustrated in FIGS. 11A-11F.

As indicated by dashed lines in FIGS. 15A-15F, It will be further understood, that in other embodiments of the invention the corners 1108, 1110, and the bottom surface 112 of a T-shaped insert 1100 may be pointed, curved, angled, straight, in any configuration or combination in accordance with the invention.

FIG. 12 illustrates an exemplary embodiment of the invention in which the T-shaped exemplary gutter filter 1100 is installed into a gutter 12 with the front and rear corners 1108, 1110 of the upper portion 1102 held between contacting the front of the gutter 12 and the roof structure and rear wall of the gutter 12. In the embodiment shown in FIG. 12, the bottom surface 1112 of the downwardly-extending rib portion 1104 is also compressively contacting the bottom surface 20 of the gutter 12.

FIG. 13 shows an exemplary embodiment of the invention which is essentially identical to the embodiment shown in FIG. 12, except that the bottom surface 1112 of the downwardly-extending rib portion 1104 does not contact the bottom surface 20 of the gutter 12. The embodiment shown in FIG. 13, depicts a situation in which the gutter 12 is so deep that the bottom surface 1112 of the T-shaped filter 1100 does not extend far enough below the top portion 1102 for the bottom surface 1112 of the insert 1100 to contact the bottom surface 20 of the gutter 12. It will be appreciated that even with this arrangement, the T-shaped gutter filter 1100 essentially divides the interior of the gutter 12 into a front and a rear passage of water 32, 34.

FIG. 14 is an exemplary embodiment of the invention which is substantially identical to the embodiment shown in FIG. 13, with the exception that the T-shaped gutter filter apparatus 1100 is supported by a gutter hanger, illustrated in FIG. 14 by a standard gutter nail and ferrule arrangement 1120. With such an embodiment, the T-shaped gutter filter 1100 is sliced from the bottom surface 1112 upward through at least a portion of the downwardly-extending rib portion 1104, and in some embodiments also partly through the top portion 1102 of the gutter filter apparatus 1100. The slice in the gutter filter 1100 is then spread apart and the gutter filter 1100 is pressed down into the open top of the gutter 12 in such a manner that the front and rear corners 1108, 1110 are compressively captured between the front inside surface of the gutter and the roof and rear surface 36 of the gutter, in the same manner as described previously with regard to FIGS. 12 and 13. In the embodiment illustrated in FIG. 14, however, the gutter filter 1100 is also supported by being suspended upon the gutter hanger arrangement 1120. It will be understood that, although the embodiment shown in FIG. 14 does not have the bottom surface 1112 of the insert 1100 in contact with the bottom surface 20 of the gutter 12, in other embodiments of the invention, installed in accordance otherwise with FIG. 14, the bottom surface 1112 of the gutter filter 1100 may contact the bottom surface 20 of the gutter 12.

It will be understood, by those having skill in the art, that a T-shaped gutter filter 1100, in accordance with the invention, provides a number of advantages over prior gutter filter arrangements. Specifically, it will be appreciated that the addition of the downwardly-extending rib portion 1104 increases the structural strength and stability of the gutter filter 1100, without adversely affecting other advantages of the invention, such as the provision of a substantially open drainage area in the form of the front and rear flow channels 32, 34.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

What is claimed is:

1. A rain gutter filter apparatus, for a gutter having an open top defining a top width of the gutter, the filter apparatus comprising:

a filter element of reticulated foam material having a top surface thereof with a width substantially matching the top width of the gutter, a bottom surface having a width less than the width of the top surface of the filter element, and front and rear surfaces thereof extending upward from the bottom surface, to thereby form a front and a rear open passage for water to the front and rear of the bottom surface when the filter element is installed into the gutter.

2. The rain gutter filter apparatus of claim 1, comprising multiple filter elements adapted to be disposed end to end with one another in the gutter.

3. The rain gutter filter apparatus of claim 1, wherein the filter element is comprised of reticulated foam material having a composition that is flame resistant, germicidal, mold resistant, and resistant to degradation by exposure to ultraviolet rays.

4. The rain gutter filter apparatus of claim 1, wherein the reticulated foam material provides a cell count in the range of 20 to 40 cells per inch.

5. The rain gutter filter apparatus of claim 3, wherein the reticulated foam material provides a cell count of approximately 30 plus or minus 6 cells per inch.

6. The rain gutter filter apparatus of claim 1, wherein the filter element is configured to balance on the bottom surface, when the bottom surface is supported on a horizontal surface.

7. The rain gutter filter apparatus of claim 6, wherein the filter element is comprised of reticulated foam material having a composition that is flame resistant, germicidal, mold resistant, and resistant to degradation by exposure to ultraviolet rays.

8. The rain gutter filter apparatus of claim 1, wherein the bottom surface is flat.

9. The rain gutter filter apparatus of claim 1, wherein the at least one of the front and rear surfaces are angled surfaces.

10. The rain gutter filter apparatus of claim 1, wherein at least one of the front and rear surfaces is curvilinear in shape.

11. The rain gutter filter apparatus of claim 1, wherein the top surface is sloped, in such a manner that when the filter element is installed in the gutter, the sloped surface extends upward to a point of substantial contact with a sloped roof.

12. The rain gutter filter apparatus of claim 1, wherein the filter element is substantially T-shaped having a top portion of the filter element configured to extend substantially across the top of the gutter when the filter element is installed into the gutter, and further having the bottom surface and front and rear surfaces thereof, configured to form a rib portion extending downward into the gutter from the top portion when the filter element is installed into the gutter.

13. The rain gutter filter apparatus of claim 12, wherein the bottom surface of the filter element contacts the bottom surface of the gutter when the filter element is installed into the gutter.

14. The rain gutter filter apparatus of claim 12, wherein the bottom surface of the filter element does not contact the bottom surface of the gutter when the filter element is installed into the gutter.

15. The rain gutter filter apparatus of claim 1, wherein a distal end of a downwardly extending portion of the filter element contacts the bottom surface of the gutter when the filter element is installed into the gutter.

16. The rain gutter filter apparatus of claim 1, wherein a distal end of a downwardly extending portion of the filter element does not contact the bottom surface of the gutter when the filter element is installed into the gutter.

17. The rain gutter filter apparatus of claim 1, wherein, the gutter includes gutter hanger arrangements extending across the open top of the gutter between a front and rear wall of the gutter at spaced intervals and through the filter element in such a manner that the filter element is at least partly supported and secured in the gutter by the gutter hanger arrangements.

18. The rain clutter filter apparatus of claim 17, wherein a distal end of a downwardly extending portion of the filter element contacts the bottom surface of the gutter when the filter element is installed into the gutter.

19. The rain clutter filter apparatus of claim 17, wherein a distal end of a downwardly extending portion of the filter element does not contact the bottom surface of the gutter when the filter element is installed into the gutter.

20. The rain gutter filter apparatus of claim 1, wherein, the filter element further comprises a fire retardant.

21. The rain gutter filter apparatus of claim 20, wherein, the reticulated foam comprises a polyurethane foam.

22. The rain clutter filter apparatus of claim 20, wherein, the filter element further comprises one or more additives from the group consisting of:

a UV stabilizer;
a germicidal additive;
an anti-microbial additive; and
a color additive.

23. The rain clutter filter apparatus of claim 22, wherein, the reticulated foam material comprises a polyurethane foam.

24. A gutter filter element adapted to fit within a gutter having an open top defining a top width of the gutter, the gutter filter element comprising:

a reticulated foam material and having a top surface thereof with a width substantially matching the top width of the gutter, a bottom surface having a width less than the width of the top surface of the filter element, and front and rear surfaces thereof extending upward from the bottom surface, to thereby form a front and rear open passage for water to the front and rear of the bottom surface when the filter element is installed into the gutter;

the reticulated foam material including a fire retardant additive.

25. The gutter filter element of claim 24, wherein, the reticulated foam material further comprises one or more additives from the group consisting of:

a UV stabilizer;
a germicidal additive;
an anti-microbial additive; and
a color additive.

26. The gutter filter element of claim 24, wherein the reticulated foam material comprises reticulated polyurethane foam.

27. The gutter filter element of claim 24, wherein the reticulated foam material comprises reticulated polyether foam.

28. A method for installing a rain gutter filter apparatus, for a gutter having an open top defining a top width of the gutter, the method comprising:

inserting into the gutter, a filter element of reticulated foam material having a top surface thereof with a width substantially matching the top width of the gutter, a bottom surface having a width less than the width of the top surface of the filter element, and front and rear surfaces thereof extending upward from the bottom surface, to thereby form a front and a rear open passage for water to the front and rear of the bottom surface when the filter element is installed into the gutter.

29. The method of claim 28, further comprising installing the filter element into the gutter prior to attaching the gutter to a roof.

30. The method of claim 28, further comprising inserting multiple filter elements end to end with one another into the gutter.

31. The method of claim 28, further comprising forming the filter element from a reticulated foam having a composition that is flame resistant, germicidal, mold resistant, and resistant to degradation by exposure to ultraviolet rays.

32. The method of claim 28, further comprising forming the filter element from a reticulated foam having a cell count in the range of 20 to 40 cells per inch.

33. The method of claim 32, further comprising forming the filter element from a reticulated foam material having a cell count of approximately 30 plus or minus 6 cells per inch.

* * * * *